United States Patent [19]

Jones

[11] Patent Number: 4,649,064

[45] Date of Patent: Mar. 10, 1987

[54] RAPID-DRYING RECORDING ELEMENT FOR LIQUID INK MARKING

[75] Inventor: Raymond T. Jones, Webster, N.Y.

[73] Assignee: Eastman Kodak Company, Rochester, N.Y.

[21] Appl. No.: 837,993

[22] Filed: Mar. 10, 1986

[51] Int. Cl.[4] ..... B41M 5/00

[52] U.S. Cl. ..... 427/256; 346/1.1; 346/135.1; 427/385.5; 428/195; 428/475.2; 428/478.2; 428/689

[58] Field of Search ..... 428/195, 207, 211, 411.1, 428/475.2, 478.2, 480, 689; 346/1.1, 135.1, 227; 427/256, 331, 372.2, 384, 385.5

[56] References Cited

U.S. PATENT DOCUMENTS

| | | | |
|---|---|---|---|
| 3,889,270 | 6/1975 | Hoffmann et al. | 346/1 |
| 4,371,582 | 2/1983 | Sugiyama et al. | 428/341 |
| 4,381,185 | 4/1983 | Swanson et al. | 8/506 |
| 4,446,174 | 5/1984 | Maekawa et al. | 427/261 |
| 4,528,242 | 7/1985 | Burwasser | 428/413 |
| 4,554,181 | 11/1985 | Cousin et al. | 427/261 |
| 4,564,560 | 1/1986 | Tani et al. | 428/195 |
| 4,575,465 | 3/1986 | Viola | 428/195 |

*Primary Examiner*—Bruce H. Hess
*Attorney, Agent, or Firm*—Alfred P. Lorenzo

[57] ABSTRACT

A rapid-drying image-recording element adapted for water-based liquid ink marking, in devices such as pen plotters, ink jet printers and the like, comprises a support having thereon a hydrophilic ink-receiving layer which is cross-linked to a degree sufficient to render it non-blocking and waterfast while permitting it to rapidly absorb a water-based liquid ink. The element is utilized in combination with a water-based liquid ink that comprises a water-dispersible cross-linkable colorant/resin composition and the ink-receiving layer contains a cross-linking agent which cross-links the colorant/resin composition to thereby render the ink markings smear-resistant, abrasion-resistant and waterfast.

37 Claims, No Drawings

RAPID-DRYING RECORDING ELEMENT FOR LIQUID INK MARKING

FIELD OF THE INVENTION

This invention relates in general to image-recording elements and in particular to image-recording elements utilized in processes in which images are recorded by means of an ink. More specifically, this invention relates to rapid-drying image-recording elements adapted for water-based liquid ink marking. Typical applications for the image-recording elements and inks described herein include use in peripheral computer equipment such as pen plotters, ink jet printers (involving either monochrome or multi-color recording) and computer-aided design/computer-aided manufacturing (CAD/CAM) equipment.

BACKGROUND OF THE INVENTION

Image-recording elements of the type to which this invention relates typically comprise a support material having thereon an ink-receiving layer. The elements include those intended for reflection viewing, which usually have an opaque support, and those intended for viewing by transmitted light, which usually have a transparent support.

A very wide variety of different types of ink-receiving layers have been proposed heretofore. For example, U.S. Pat. No. 3,889,270 describes ink-receiving layers consisting of a protein, a polysaccharide, cellulose, a cellulose derivative, polyvinyl alcohol, a copolymer of vinyl alcohol, gelatin, albumen, casein or silica gel; U.S. Pat. No. 4,371,582 describes ink-receiving layers containing a basic polymer latex; U.S. Pat. No. 4,528,242 describes ink-receiving layers comprising a mixture of a carboxylated polymer and a polyalkylene glycol; and British Patent Applications No. 2 134 129 A and No. 2 147 003 A describe ink-receiving layers comprising a polymeric binder, a water-soluble salt of a polyvalent metal and a cationic organic material such as salts of alkylamines, quaternary ammonium salts, polyamines and basic latexes. Many patents describe ink-receiving layers comprising a pigment dispersed in a polymeric binder. Examples of such patents include U.S. Pat. Nos. 4,269,991, 4,425,405, 4,446,174, 4,474,847, 4,474,850 and 4,478,910.

Many different types of inks adapted for use in devices such as pen plotters and ink jet printers are also known and have been described in numerous patents such as, for example, U.S. Pat. Nos. 4,155,768, 4,176,361, 4,197,135, 4,395,287, 4,396,429, and 4,409,039.

While the image-recording elements and inks proposed heretofore are extremely diverse in nature, there are many unresolved problems in the art, and many deficiencies in the known products which have severely limited their commercial usefulness. The requirements for use of these inks and recording elements are very demanding. For example, the combination of ink and recording element should exhibit:

(1) rapid-drying characteristics such as result when the ink-receiving layer has the ability to rapidly absorb the ink, (2) controlled spreading characteristics such that the image is clearly and sharply defined, and (3) high image density such as results when the dye or pigment present in the ink is deposited at or near the surface of the ink-receiving layer.

In addition to being of high density, it is also desirable that the ink image be abrasion-resistant so that it is not easily rubbed off, smear resistant, so that it can be subjected to normal handling without risk of smearing, and waterfast, so that it is not harmed by contact with water or other aqueous liquids such as might come into contact with the element as a result of spills or other accidental exposure to liquids. The hydrophilic ink-receiving layer must also be waterfast to avoid removal of the ink image through dissolution or damage to the layer itself, and should also be non-blocking to facilitate packaging and handling.

As pointed out in U.S. Pat. No. 4,308,542 (see lines 40–68 of Column 1), U.S. Pat. No. 4,371,582 (see line 38, Column 2 to line 27, Column 3), and U.S. Pat. No. 4,554,181 (see lines 35–61 of Column 1), these objectives impose seemingly contradictory requirements which make the resolution of the problem exceedingly difficult. The solution proposed by U.S. Pat. No. 4,308,542 is to use a synthetic pulp paper as the recording medium and heat-treat the paper to fuse the synthetic pulp, but this has the serious disadvantage of requiring a costly and time-consuming additional step in the image-forming process. The solution proposed by U.S. Pat. No. 4,371,582 is the use of a basic latex polymer as the ink-receiving layer while U.S. Pat. No. 4,554,181 proposes use of a combination of a water-soluble polyvalent metal salt and a cationic polymer; but these techniques are often of only limited effectiveness and do not provide as high a degree of abrasion resistance and waterfastness as is desired.

It is toward the objective of providing a simple, inexpensive and readily implementable solution to the problem of meeting the diverse needs of image-recording elements adapted for use in such devices as pen plotters and ink jet printers that the present invention is directed.

SUMMARY OF THE INVENTION

In accordance with this invention, an image-recording element adapted for water-based liquid ink marking in devices such as pen plotters, ink jet printers and the like, comprises a support having on a surface thereof an ink-receiving layer of a hydrophilic cross-linkable film-forming material which is cross-linked to a degree sufficient to render it non-blocking and waterfast, while permitting it to rapidly absorb a water-based ink and thereby provide a rapid-drying element. In other words, it is cross-linked to a degree sufficient to render it non-blocking and waterfast, but insufficient to prevent it from rapidly absorbing a water-based liquid ink. The element is utilized in combination with a water-based liquid ink that comprises a water-dispersible cross-linkable colorant/resin composition and the ink-receiving layer contains a cross-linking agent which cross-links the colorant/resin composition to thereby render the ink markings smear-resistant, abrasion-resistant and waterfast.

By utilization of two cross-linking agents, both of which can be conveniently incorporated in the coating composition from which the ink-receiving layer is formed, the image-recording elements of this invention are able to effectively meet the demanding requirements of this art. One of the cross-linking agents is selected to be effective in cross-linking the hydrophilic ink-receiving layer to the desired controlled degree, and the other is selected to be effective in cross-linking the colorant/resin composition utitlized in the water-based liquid ink. The former cross-linking agent performs its cross-linking reaction during the drying of the coating which serves as the ink-receiving layer, while the latter cross-linking agent performs its cross-linking reaction during drying of the ink image.

DESCRIPTION OF THE PREFERRED EMBODIMENTS

The support materials utilized in the novel image-recording element of this invention can be opaque, translucent or transparent materials, as desired for use in any particular application. Examples of useful support materials include paper, cloth, plastic film, metallic sheet materials, and glass. Most typically, paper is used where an opaque support is desired, and plastic film is used where a translucent or transparent support is desired. Suitable subbing layers, as are well known in the photographic arts, can be used to ensure adequate adhesion of the hydrophilic ink-receiving layer to the support.

For the preparation of transparent image-recording elements, the preferred support materials are those known to be useful as supports in the manufacture of photographic films. For example, the support can be composed of cellulose esters such as cellulose triacetate, cellulose acetate propionate or cellulose acetate butyrate, polyesters such as poly(ethylene terephthalate), polyamides, polycarbonates, polyimides, polyolefins, poly(vinyl acetals), polyethers, polysulfonamides, and the like. Polyester supports, and especially poly(ethylene terephthalate), are preferred because of their excellent dimensional stability characteristics.

The ink-receiving layer in the novel rapid-drying image-recording elements of this invention is formed from a hydrophilic cross-linkable film-forming material. A very wide variety of such materials are known and commonly employed in the manufacture of photographic elements. Useful materials include proteins, protein derivatives, cellulose derivatives such as carboxymethyl cellulose, hydroxyethyl cellulose and water-soluble cellulose acetate, polyvinyl alcohol, polyacrylamide, polyvinyl pyrrolidone, gelatin—e.g., alkali-treated gelatin (cattle bone or hide gelatin) or acid-treated gelatin (pigskin gelatin), gelatin derivatives—e.g., acetylated gelatin, phthlated gelatin and the like, polysaccharides such as dextran, gum arabic, zein, casein, pectin, collagen derivatives, collodion, agar-agar, arrowroot, albumin and the like as described in Yutzy et al U.S. Pat. Nos. 2,614,928 and 2,614,929, Lowe et al U.S. Pat. Nos. 2,691,582, 2,614,930, 2,614,931, 2,327,808 and 2,448,534, Gates et al U.S. Pat. Nos. 2,787,545 and 2,956,880, Himmelmann et al U.S. Pat. No. 3,061,436, Farrell et al U.S. Pat. No. 2,816,027, Ryan U.S. Pat. Nos. 3,132,945, 3,138,461 and 3,186,846, Dersch et al U.K. Pat. No. 1,167,159 and U.S. Pat. Nos. 2,960,405 and 3,436,220, Geary U.S. Pat. No. 3,486,896, Gazzard U.K. Pat. No. 793,549, Gates et al U.S. Pat. Nos. 2,992,213, 3,157,506, 3,184,312, and 3,539,353, Miller et al U.S. Pat. No. 3,227,571, Boyer et al U.S. Pat. No. 3,532,502, Malan U.S. Pat. No. 3,551,151, Lohmer et al U.S. Pat. No. 4,018,609, Luciani et al U.K. Pat. No. 1,186,790, U.K. Pat. No. 1,489,080 and Hori et al Belgian Pat. No. 856,631, U.K. Pat. No. 1,490,644, U.K. Pat. No. 1,483,551, Arase et al U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al U.S. Pat. No. 2,725,293, Hilborn U.S. Pat. No. 2,748,022, DePauw et al U.S. Pat. No. 2,956,883, Ritchie U.K. Pat. No. 2,095, DeStubner U.S. Pat. No. 1,752,069, Sheppard et al U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al U.S. Pat. No. 3,923,517.

Gelatin is a particularly preferred material for use in forming the ink-receiving layer of transparency materials. Among the reasons is the fact that it forms a clear coating, is readily cross-linked in an easily controllable manner, and is highly absorptive of water-based liquid inks to thereby provide rapid-drying characteristics.

The ink-receiving layer is cross-linked in the image-recording elements of this invention to provide such desired features as waterfastness and non-blocking characteristics. The cross-linking is also useful in providing abrasion resistance and resistance to the formation of fingerprints on the element as a result of handling.

Non-blocking characteristics are an especially important feature of the ink-receiving layer in the image-recording elements of this invention. The image-recording element is typically used in sheet form—with a large number of sheets being stacked together one upon another in the package which is marketed—or in roll form. In either case, it is important that the ink-receiving layer be non-blocking, so that adjacent sheets do not adhere together in the package and so that adjacent convolutions do not adhere together in the roll.

There are a vast number of known cross-linking agents—also known as hardening agents—that will function to cross-link hydrophobic film-forming materials, and they are commonly used in the photographic industry to harden gelatin emulsion layers and other layers of photographic elements.

Hardening agents can be used individually or in combination and in free or in blocked form. A great many useful hardeners are known, including formaldehyde and free dialdehydes, such as succinaldehyde and glutaraldehyde, as illustrated by Allen et al U.S. Pat. No. 3,232,764; blocked dialdehydes, as illustrated by Kaszuba U.S. Pat. No. 2,586,168, Jeffreys U.S. Pat. No. 2,870,013, and Yamamoto et al U.S. Pat. No. 3,819,608; α-diketones, as illustrated by Allen et al U.S. Pat. No. 2,725,305; active esters of the type described by Burness et al U.S. Pat. No. 3,542,558, sulfonate esters, as illustrated by Allen et al U.S. Pat. Nos. 2,725,305 and 2,726,162; active halogen compounds, as illustrated by Burness U.S. Pat. No. 3,106,468, Silverman et al U.S. Pat. No. 3,839,042, Ballantine et al U.S. Pat. No. 3,951,940 and Himmelmann et al U.S. Pat. No. 3,174,861; s-triazines and diazines, as illustrated by Yamamoto et al U.S. Pat. No. 3,325,287, Anderau et al U.S. Pat. No. 3,288,775 and Stauner et al U.S. Pat. No. 3,992,366; epoxides, as illustrated by Allen et al U.S. Pat. No. 3,047,394, Burness U.S. Pat. No. 3,189,459 and Birr et al German Pat. No. 1,085,663; aziridines, as illustrated by Allen et al U.S. Pat. No. 2,950,197, Burness et al U.S. Pat. No. 3,271,175 and Sato et al U.S. Pat. No. 3,575,705; active olefins having two or more active bonds, as illustrated by Burness et al U.S. Pat. Nos. 3,490,911, 3,539,644 and 3,841,872 (U.S. Pat. No. Re. 29,305), Cohen U.S. Pat. No. 3,640,720, Kleist et al German Pat. No. 872,153 and Allen U.S. Pat. No. 2,992,109; blocked active olefins, as illustrated by Burness et al U.S. Pat. No. 3,360,372 and Wilson U.S. Pat.

No. 3,345,177; carbodiimides, as illustrated by Blout et al German Pat. No. 1,148,446; isoxazolium salts unsubstituted in the 3-position, as illustrated by Burness et al U.S. Pat. No. 3,321,313; esters of 2-alkoxy-N-carboxydihydroquinoline, as illustrated by Bergthaller et al U.S. Pat. No. 4,013,468; N-carbamoyl and N-carbamoylopyridinium salts, as illustrated by Himmelmann U.S. Pat. No. 3,880,665; hardeners of mixed function, such as halogen-substituted aldehyde acids (e.g., mucochloric and mucobromic acids), as illustrated by White U.S. Pat. No. 2,080,419, onium substituted acroleins, as illustrated by Tschopp et al U.S. Pat. No. 3,792,021, and vinyl sulfones containing other hardening functional groups, as illustrated by Sera et al U.S. Pat. No. 4,028,320; and polymeric hardeners, such as dialdehyde starches, as illustrated by Jeffreys et al U.S. Pat. No. 3,057,723, and copoly(acroleinmethacrylic acid), as illustrated by Himmelmann et al U.S. Pat. No. 3,396,029.

The use of hardeners in combination is illustrated by Sieg et al U.S. Pat. No. 3,497,358, Dallon et al U.S. Pat. Nos. 3,832,181 and 3,840,370 and Yamamoto et al U.S. Pat. No. 3,898,089. Hardening accelerators can be used, as illustrated by Sheppard et al U.S. Pat. No. 2,165,421, Kleist German Pat. No. 881,444, Riebel et al U.S. Pat. No. 3,628,961 and Ugi et al U.S. Pat. No. 3,901,708.

A key feature of this invention is the use of two different cross-linking agents, one of which reacts with the hydrophilic film-forming material that makes up the ink-receiving layer and the other of which reacts with the colorant/resin composition present in the water-based liquid ink. Both cross-linking agents are incorporated in the coating composition used to form the ink-receiving layer. The cross-linking action of the cross-linking agent that reacts with the hydrophilic film-forming material occurs during the drying of the ink-receiving layer. The cross-linking action of the cross-linking agent that reacts with the colorant/resin composition occurs during the drying of the ink. To achieve the objectives of this invention of an ink-receiving layer which is non-blocking and waterfast yet will rapidly absorb the water-based liquid ink that is applied thereto, the cross-linking agent that reacts with the hydrophilic film-forming material must not harden it to too low a degree—or the ink-receiving layer will tend to block and tend to dissolve in water because it is unduly soft—nor harden it to too high a degree, or the ink-receiving layer will not rapidly absorb the ink and may not permit the dried ink to bond strongly thereto because it is unduly hard. Moreover, the cross-linking agent that reacts with the colorant/resin composition must not interfere with the hardening of the ink-receiving layer either by preventing adequate hardening or by causing excessive hardening.

In summary, the essential characteristics of the cross-linking agent that reacts with the colorant/resin composition are that it be water-soluble, that it be compatible with the hydrophilic film-forming material that makes up the ink-receiving layer, that it does not interfere significantly with the hardening of the hydrophilic film-forming material, and that it readily cross-links the ink during ink drying. Any cross-linking agent that meets these requirements is acceptable.

Water-soluble salts of multi-valent metals are especially useful as cross-linking agents for the water-based inks. The useful salts include salts of mineral acids and salts of organic acids. Multi-valent metals which can be employed include copper, iron, lead, nickel, cobalt, aluminum, zinc, chromium, calcium, magnesium, barium, strontium, and manganese. The types of salts which can be employed include nitrates, sulfates, chlorides, acetates, formates, borates, salicylates, malates, acetylacetonates, propionates, butyrates, bromides, benzoates, phthalates, fluorides, iodides, thiocyanates, and the like.

Carboxylic acid salts of multi-valent metals are especially useful, including those of monocarboxylic and polycarboxylic acids of either aliphatic or aromatic types. Preferred salts are those of carboxylic acids containing 1 to 3 carboxyl groups and up to 20 carbon atoms. Typical examples of carboxylic acid salts of polyvalent metals which are useful for the purposes of this invention include:

lead formate
lead acetate
lead bromide
lead propionate
lead nitrate
calcium acetate
calcium bromide
calcium butyrate
calcium chloride
calcium isobutyrate
calcium phthalate
calcium propionate
chromium chloride
chromium sulfate
magnesium acetate
magnesium butyrate
magnesium chloride
magnesium malate
magnesium phthalate
and the like.

The terms by which the carboxylic acid salts are identified herein are used in a generic sense to include salts of the metal in any of its stable oxidation states. For example, the term "lead acetate" is intended to encompass both the acetate of divalent lead, which has the formula $(CH_3COO)_2Pb$ and is commonly referred to as lead diacetate, and the acetate of tetravalent lead, which has the formula $(CH_3COO)_4Pb$ and is commonly referred to as lead tetraacetate. These terms are also intended to encompass both the anhydrous and hydrated forms of the metal salts.

In carrying out the present invention, adequate care must be taken to ensure that the agent selected to cross-link the ink does not interfere significantly with the cross-linking of the hydrophilic film-forming material that makes up the ink-receiving layer. It is not feasible to utilize the agent which cross-links the hydrophilic film-forming material to also cross-link the ink, since if such agent were used in excess, it would overharden the hydrophilic film-forming material and render it insufficiently hydrophilic to rapidly absorb a water-based ink.

To form the ink-receiving layer, the hydrophilic cross-linkable film-forming material, the cross-linking agent for such material, and the cross-linking agent for the ink are combined together in an aqueous solution or dispersion, coated as a thin layer on the support material, and dried. The composition can be coated on the support material by any of a number of suitable procedures, including immersion or dip coating, roller coating, reverse roll coating, air knife coating, doctor blade coating, gravure coating, spray coating, extrusion coating, bead coating, stretch-flow coating and curtain coating. Drying of the coated layer can be carried out over a wide range of temperatures, for example at temperatures of from about 80° C. to about 140° C., and more preferably from about 115° C. to about 125° C.

The thickness of the ink-receiving layer can be varied widely, as desired, depending upon the particular application in which the image-recording element is to be used. Generally speaking, elements for use in ink jet recording will require a thicker ink-receiving layer than elements for use with pen plotters, since ink jet recording utilizes a greater deposition of ink, which requires a thicker layer to be effectively absorbed. Typically, the ink-receiving layer has a dry thickness in the range of from about 0.0004 to about 0.008 millimeters, and more usually in the range of from about 0.0008 to about 0.0016 millimeters.

The proportions of the ingredients making up the coating composition which forms the ink-receiving layer can be varied widely to meet the requirements of the particular element involved. Typically, the cross-linking agent which cross-links the hydrophilic film-forming material is utilized in an amount of from about 0.01 to about 0.1 parts per part by weight of the hydrophilic film-forming material, and more preferably, in an amount of from about 0.03 to about 0.07 parts per part by weight. Typically, the cross-linking agent which cross-links the ink is utilized in an amount of from about 0.05 to about 0.9 parts per part by weight of the hydrophilic film-forming material, and more preferably in an amount of from about 0.2 to about 0.5 parts per part by weight.

In addition to the hydrophilic film-forming material and the two cross-linking agents, the composition used to form the ink-receiving layer can contain other ingredients such as surfactants which promote coatability and matting agents which contribute to the non-blocking characteristics. Useful matting agents include materials such as starch, titanium dioxide, zinc oxide, calcium carbonate, barium sulfate, colloidal silica and polymeric beads, such as polymethyl methacrylate beads.

When a polyester is used as the support material, a subbing layer is advantageously employed to improve the bonding of the ink-receiving layer to the support. Useful subbing compositions for this purpose are well known in the photographic art and include, for example, interpolymers of vinylidene chloride such as vinylidene chloride/acrylonitrile/acrylic acid terpolymers or vinylidene chloride/methyl acrylate/itaconic acid terpolymers.

Generally speaking, it is not detrimental in the present invention if the agent which cross-links the ink reacts with the colorant as well as with functional groups present on the resin of the colorant/resin composition. Moreover, if desired, an agent that is specifically selected to react with the colorant can be included in the ink-receiving layer in addition to the agent for cross-linking the ink. Thus, for example, where the colorant utilized is an anionic dye, the ink-receiving layer can contain a cationic agent that reacts therewith, such as a vinylbenzyl quaternary ammonium polymer, as described in Kelley et al, U.S. Pat. No. 4,070,188, issued Jan. 24, 1978, and references discussed therein.

The inks utilized in this invention can be of neutral, acid or alkaline pH. They are water-based inks comprising a water-dispersible cross-linkable colorant/resin composition. By the term "colorant/resin composition", as used herein, is meant a composition in which a pigment or dye, is dissolved in or otherwise uniformly dispersed throughout a resin. In accordance with conventional practice, the term "colorant" is used herein to include both dyes and pigments, so that the colorant/resin compositions of this invention include dye/resin compositions and pigment/resin compositions. Any kind of dye or pigment can be used in the present invention, as long as it is capable of being incorporated in an adequate amount in a water-dispersible cross-linkable resin to thereby form a colorant/resin composition. The water-based ink can contain, in addition to the colorant/resin composition, other agents which are conventionally employed in inks such as, for example, wetting agents, sequestering agents, pH buffering agents, viscosity modifying agents, and the like.

In the present invention, it is necessary that the ink and the cross-linking agent for the ink be appropriately selected so that the resin in the colorant/resin composition has functional groups which are capable of reacting with such cross-linking agent. Many different types of functional groups can be usefully employed. Sulfonate groups are especially advantageous in that they perform the dual function of promoting the water-dispersibility of the colorant/resin composition and of providing cross-linkable sites.

Water-dispersible cross-linkable colorant/resin compositions, and their use in inks, are known to the art and are described, for example, in Blackwell et al, U.S. Pat. No. 4,148,779, issued Apr. 10, 1979, the disclosure of which is incorporated herein by reference.

Water-dispersible cross-linkable polyesters and polyesteramides which are especially useful as resins in the colorant/resin compositions employed in the present invention are also described in Shields et al, U.S. Pat. No. 3,546,008, issued Dec. 8, 1970, Kibler et al, U.S. Pat. No. 3,734,874 issued May 22, 1973, O'Neill et al, U.S. Pat. No. 4,073,777 issued Feb. 14, 1978, Sublett, U.S. Pat. No. 4,233,196 issued Nov. 11, 1980, and Coney, U.S. Pat. No. 4,335,220, issued June 15, 1982; the disclosures of which are incorporated herein by reference. Polyesters and polyesteramides comprising 5-sodiosulfoisophthalate are especially preferred in the present invention.

Various means are well known in the art whereby a colorant can be uniformly dispersed throughout a resin. For example, (1) a dye or pigment can be dispersed by melt blending techniques as described in Blackwell et al, U.S. Pat. No. 4,148,779, or (2) a dye can be dispersed by a "loading" technique as described in U.S. Pat. No. 4,203,716, the disclosure of which is incorporated herein by reference, or (3) a dye can be dispersed by dissolving it in polymerizable monomers and polymerizing the monomers in a suspension polymerization process as described in European Patent Application No. 0 146 337, published June 26, 1985, the disclosure of which is incorporated herein by reference.

Selection of appropriate materials for use as the hydrophilic film-forming material, the cross-linkable colorant/resin composition, the cross-linking agent that reacts with the hydrophilic film-forming material and the cross-linking agent that reacts with the colorant/resin composition can be readily carried out by any person skilled in the art in light of the teachings and principles set forth herein. Thus, for example, materials can be selected as the hydrophilic film-forming material and the colorant/resin composition in which cross-linkability is imparted thereto by different functional groups and the two cross-linking agents can then be selected on the basis of their respective abilities to react with the particular functional groups involved to effect the desired cross-linking.

In a preferred embodiment of the invention, the hydrophilic film-forming material is gelatin, the colorant/resin composition comprises a polyester or polyesteramide containing sulfonate functional groups, the cross-linking agent which reacts with the hydrophilic film-forming material is a vinylsulfonyl compound, and the cross-linking agent which reacts with the colorant/resin composition is a multi-valent metal acetate. The vinylsulfonyl compound reacts with the amino and carboxyl groups which are present in gelatin to thereby effect the cross-linking of the ink-receiving layer. The multi-valent metal acetate does not react with the amino or carboxyl groups of gelatin nor interfere with the reaction of the vinylsulfonyl compound, but does react with the sulfonic acid groups of the polyester or polyesteramide to thereby effect the desired cross-linking of the ink.

Vinylsulfonyl compounds are well known and particularly effective hardening agents—that is crosslinking agents—for gelatin. The vinylsulfonyl hardeners are characterized by the inclusion of a plurality of vinylsulfonyl groups. In perhaps the simplest possible structural form, divinylsulfone, a single sulfonyl group joins two vinyl groups. Most typically a plurality of vinylsulfonylalkyl groups, such as vinylsulfonylmethyl, ethyl, propyl or butyl groups, are joined through an intermediate ether, amine, diamine or hydrocarbon linkage. Bis(-vinylsulfonyl)ethers such as bis(vinylsulfonylmethyl) and bis(vinylsulfonylethyl)ethers have been found particularly suitable for use as hardeners. Representative vinylsulfonyl hardeners as well as procedures for their synthesis and use are disclosed in Burness et al U.S. Pat. Nos. 3,490,911, issued Jan. 20, 1970; 3,539,644, issued Nov. 10, 1970 and 3,642,486, issued Feb. 15, 1972, the disclosures of which are incorporated herein by reference.

Illustrative examples of useful vinylsulfonyl hardeners include:

bis(vinylsulfonylmethyl)ether
bis(2-vinylsulfonylethyl)ether
bis(4-vinylsulfonylbutyl)ether
N,N-bis(2-vinylsulfonylethyl)-n-propylamine
N,N'-bis(2-vinylsulfonylethyl)piperazine
bis[2-(2-vinylsulfonylethoxy)ethyl]sulfone and
N,N'-bis[2-(2-vinylsulfonylethoxy)ethyl]urea.

In a particularly preferred embodiment of the invention, the hydrophilic film-forming material is gelatin, the colorant/resin composition comprises a copolyester of 5-sodiosulfoisophthalic acid, the cross-linking agent that reacts with the hydrophilic film-forming material is bis(vinylsulfonylmethyl)ether, and the cross-linking agent that reacts with the colorant/resin composition is calcium acetate.

In the most preferred embodiment of this invention, the image-recording element is a transparency in which the support is a biaxially stretched and heat set poly(ethylene terephthalate) film, the hydrophilic film-forming material is gelatin, the cross-linking agent that reacts with the gelatin is bis(vinylsulfonylmethyl)ether, the cross-linking agent that reacts with the colorant/resin composition is calcium acetate, and the colorant/resin composition is a dye/resin composition as described in Blackwell et al, U.S. Pat. No. 4,148,779, namely a water-dispersible composition comprising:

(A) from about 5 to about 60% by weight of disperse dye, and (B) from about 95 to about 40% by weight of linear, water-dispersible copolyester, or (C) from 95 to about 40% by weight of a blend of the copolyester of (B) with up to about 40% by weight based on total weight of said blend of a saturated aliphatic or cycloaliphatic dicarboxylic acid having 6 to 12 carbon atoms, said copolyester being comprised of (D) at least one aliphatic, cycloaliphatic or aromatic dicarboxylic acid component, (E) a diol component of from about 2 to about 28 carbons, at least about 20 mole percent of which is a poly(ethylene glycol) having the formula $H—OCH_2CH_2)_nOH$ wherein n is an integer of from 2 to about 14, and (F) at least one difunctional dicarboxylic acid containing a $—SO_3M$ group attached to an aromatic nucleus, wherein M is hydrogen, $Na^+$, $Li^+$ or $K^+$, and constituting at least about 8 mole percent to about 45 mole percent of the total moles of components (D) and (F).

As explained in Blackwell et al, U.S. Pat. No. 4,148,779, the disperse dye, i.e., water-insoluble dye, can be of any chemical class such as azo, anthraquinone, methine and disazo which is characterized by the absence of any pendant water-solubilizing groups such as a sulfonic acid group or a salt thereof. As also explained in U.S. Pat. No. 4,148,779, in a preferred dye/resin composition, the copolyester acid moiety is comprised of 90–92 mole % isophthalic acid and 8–10 mole % 5-sodiosulfoisophthalic acid, and the diol is diethylene glycol, and in a particularly preferred dye/resin composition, the copolyester acid moiety is comprised of 87–83 mole % isophthalic acid and 13–17 mole % 5-sodiosulfoisophthalic acid, and the diol moiety is comprised of 72–68 mole % diethylene glycol and 28–32 mole % 1,4-cyclohexanedimethanol.

The dye/resin composition of U.S. Pat. No. 4,148,779 is especially beneficial in the most preferred embodiment of this invention because it is readily cross-linked, because it adheres tenaciously to the gelatin that makes up the ink-receiving layer, and because it provides a sharp, dense image.

Typical examples of pigments which are useful for the purposes of this invention include:

iron oxides
copper oxides
manganese oxides
lead chromates
cobalt aluminates
carbon blacks
phthalocyanine pigments
ferrocyanide pigments
and the like.

The pigments can be blended in any suitable manner with the resin to form a pigment/resin composition useful in a water-based liquid ink.

As used herein, the following terms are intended to have the following meanings:

"water-based liquid ink"—any liquid ink in which the liquid medium is predominantly water.

"water-dispersible"—capable of forming a true solution, colloidal dispersion or suspension in water.

"waterfast"—capable of resisting dissolution by water encountered under the conditions of handling and use to which the element is subject.

"non-blocking elements"—elements which are capable of being stacked without adhering together sufficiently to cause significant damage when separated.

"colorant/resin composition"—any combination of a dye or pigment and a resin in which the dye or pigment is dissolved in or otherwise substantially uniformly dispersed throughout the resin.

The invention is further illustrated by the following examples of its practice.

EXAMPLES 1-7

A biaxially stretched and heat set poly(ethylene terephthalate) film coated with a subbing layer comprising a terpolymer of acrylonitrile, vinylidene chloride and acrylic acid was utilized as a support material for an image-recording element of the type described herein. A series of aqueous coating compositions comprised of gelatin, a para-isononylphenoxy polyglycidol surfactant, polymeric beads which serve as a matting agent, bis(vinylsulfonylmethyl)ether, and calcium acetate were used to form ink-receiving layers on the aforesaid support material. In each case, the composition was coated in an amount of 1.076 grams per square meter, and the amounts of calcium acetate and bis(vinylsulfonylmethyl)ether (referred to as BVSME) were as indicated in Table I below, with such amounts being reported as percent by weight based on the weight of gelatin. Tests were carried out with two different inks, a red ink and a blue ink, both of which were prepared in accordance with the examples of Blackwell et al, U.S. Pat. No. 4,148,779, issued Apr. 10, 1979. The dye used in the red ink is identified as Color Index Disperse Red 339 and that in the blue ink as Color Index Disperse Blue 337. The inks were used to form images on the ink-receiving layer of the above-described elements by application with a hand-held pen and, in each case, the time for the ink to dry was measured and the ability of the element to withstand immersion in hot water was determined by establishing the temperature at which the ink image was removed from the element. In these tests, the element was immersed in water at room temperature and the water was heated to a temperature at which the ink image separated from the element, or to boiling if no separation took place theretofore. The drying time reported is the time required for there to be no smearing when a finger is wiped across the ink markings.

TABLE I

| Test No. | % Calcium Acetate | % BVSME | Drying Time (seconds) Red Ink | Drying Time (seconds) Blue Ink | Temperature at Which Ink is Removed (°C.) Red Ink | Temperature at Which Ink is Removed (°C.) Blue Ink |
|---|---|---|---|---|---|---|
| 1 | 5 | 1.5 | 20 | 40 | 77 | >100 |
| 2 | 10 | 0.75 | 15 | 25 | 93 | >100 |
| 3 | 15 | 0.75 | 15 | 25 | >100 | >100 |
| 4 | 25 | 0.75 | 15 | 20 | 88 | >100 |
| 5 | 10 | 1.5 | 35 | 40 | >100 | >100 |
| 6 | 15 | 1.5 | 5 | 10 | 93 | >100 |
| 7 | 25 | 1.5 | 20 | 20 | 93 | >100 |

The results reported above indicate that, in each case, the ink dried rapidly and that the ink image was able to withstand immersion in very hot water, in many cases even in boiling water. In all instances, the elements were non-blocking and the ink image was sharp, dense, non-smearing and abrasion-resistant.

In contrast with the above results, when an otherwise identical ink-receiving layer was coated except that the calcium acetate was omitted, the drying times were similar (15 seconds for the red ink and 25 seconds for the blue), but both the red ink and blue ink images were removed from the element at a water temperature of only 49° C. Such an element would not be able to survive without damage if hot coffee, or other hot beverage, which are typically at a temperature of about 70° C., were spilled on it.

Additional tests were carried out in which aluminum sulfate was used in place of calcium acetate. The aluminum sulfate was employed in amounts of 10%, 15% and 25%, with BVSME at a level of 0.75% and with BVSME at a level of 3.0%. In each case, satisfactory drying time of 40 seconds or less was obtained, but the ink image separated from the element at a water temperature of 49° C. This can be explained by the fact that calcium acetate will not react with either the amino or carboxyl groups present on gelatin, but will react with the sulfonic acid groups present on the resin of the dye/resin composition (the structure of the cross-link is one calcium ion reacted with two sulfonic acid groups on separate polymer chains). On the other hand, aluminum sulfate can react with carboxyl groups, but not amino groups, present on gelatin and can react with the sulfonic acid groups on the resin. Because of its ability to react with carboxyl groups present on gelatin, aluminum sulfate interferes with the cross-linking of the gelatin by the BVSME and apparently overhardens the gelatin so that the ink image will not adhere adequately. Reaction of the aluminum sulfate with the gelatin also makes it less available for reaction with the dye/resin composition, and this probably also contributed to the poor results obtained. Thus, aluminum sulfate is not an effective choice of cross-linking agent in the specific system described. It would, however, be effective under other conditions where the functional groups on the hydrophilic film-forming material and/or the dye/resin composition were different. For example, it could be successfully used if the hydrophilic film-forming material was hydroxyethyl cellulose.

EXAMPLES 8-10

Example 2 was repeated except for variation in the coverage of the ink-receiving layer as described in Table II below. In each case, rapid drying of the ink was achieved, and the image-recording element was able to withstand immersion in boiling water.

TABLE II

| Test No. | Coverage (gms/m$^2$) | Drying Time (seconds) Red Ink | Drying Time (seconds) Blue Ink | Temperature at Which Ink is Removed (°C.) Red Ink | Temperature at Which Ink is Removed (°C.) Blue Ink |
|---|---|---|---|---|---|
| 8 | 0.54 | 10 | 20 | >100 | >100 |
| 9 | 0.81 | 15 | 20 | >100 | >100 |
| 10 | 1.076 | 15 | 20 | >100 | >100 |

Applicant is not certain of the mechanisms whereby his unique combination of cross-linkable ink and cross-linked image-recording element provides the excellent performance characteristics which he has observed, and does not wish to be bound by any theoretical explanations of the manner in which his invention functions. However, it is believed that by providing an appropriately moderate degree of cross-linking in the hydrophilic ink-receiving layer, it is able to "wick" the water in the ink away from the surface and leave most of the colorant/resin composition at or near the surface to maximize image density and sharpness. Very little lateral diffusion of the colorant/resin composition occurs, whereas the water in the ink penetrates deeply into the ink-receiving layer and does diffuse laterally. At the same time, the ink-receiving layer is sufficiently cross-linked that it is non-blocking, has a high degree of abrasion resistance, and is resistant to removal by contact with water or other liquids. Because it contains a colorant/resin composition, the ink utilized with the recording element adheres very strongly to the ink-receiving layer, i.e., the resin greatly promotes the adhesion. The cross-linking agent which is contained within the cross-linked ink-receiving layer readily cross-links the colorant/resin composition during drying of the ink, whereby the ink markings deposited on the element not only adhere tenaciously, but are rendered abrasion-resistant, smear-resistant, and waterfast. Thus, the unique combination of image-recording element and water-based ink provided by this invention has unparalleled advantages in this art, including very rapid drying characteristics, excellent control of image spreading characteristics, formation of dense sharp images, excellent non-blocking characteristics, freedom from the disadvantages and hazards of requiring organic solvents in the ink, and formation of a non-smearing, abrasion-resistant, waterfast ink image which is so durable and so strongly bonded to the ink-receiving layer, that the element is able to successfully withstand immersion in boiling water.

The invention has been described in detail with particular reference to preferred embodiments thereof, but it will be understood that variations and modifications can be effected within the spirit and scope of the invention.

What is claimed is:

1. An image-recording element adapted for water-based liquid ink marking in devices such as pen plotters, ink jet printers and the like, said element comprising a support having on a surface thereof an ink-receiving layer of a hydrophilic cross-linkable film-forming material which is cross-linked to a degree sufficient to render it waterfast, while permitting it to rapidly absorb a water-based ink comprising a water-dispersible cross-linkable colorant/resin composition, said ink-receiving layer comprising a cross-linking agent that is capable of cross-linking a cross-linkable colorant/resin composition in a water-based liquid ink applied thereto.

2. An image-recording element as claimed in claim 1, wherein said hydrophilic cross-linkable film-forming material is gelatin.

3. An image-recording element as claimed in claim 1, wherein said ink-receiving layer comprises gelatin cross-linked by a vinylsulfonyl compound.

4. An image-recording element as claimed in claim 1, wherein said ink-receiving layer comprises gelatin cross-linked by bis(vinylsulfonylmethyl)ether.

5. An image-recording element as claimed in claim 1, wherein said support is a polyester film.

6. An image-recording element as claimed in claim 1, wherein said support is a poly(ethylene terephthalate) film.

7. An image-recording element as claimed in claim 1, wherein said cross-linking agent that is capable of cross-linking a colorant/resin composition is a water-soluble salt of a multi-valent metal.

8. An image-recording element as claimed in claim 1, wherein said cross-linking agent that is capable of cross-linking a colorant/resin composition is a water-soluble calcium salt.

9. An image-recording element as claimed in claim 1, wherein said cross-linking agent that is capable of cross-linking a colorant/resin composition is a water-soluble multi-valent metal acetate.

10. An image-recording element as claimed in claim 1, wherein said cross-linking agent that is capable of cross-linking a colorant/resin composition is calcium acetate.

11. An image-recording element as claimed in claim 1, wherein said ink-receiving layer additionally contains a matting agent.

12. An image-recording element as claimed in claim 1, wherein said ink-receiving layer additionally contains a vinylbenzyl quaternary ammonium polymer.

13. An image-recording element adapted for water-based liquid ink marking in devices such as pen plotters, ink jet printers and the like, said element comprising a transparent support having on a surface thereof an ink-receiving layer comprised of cross-linked gelatin containing a water-soluble salt of a multi-valent metal.

14. An image-recording element adapted for water-based liquid ink marking in devices such as pen plotters, ink jet printers and the like, said element comprising a polyester support having on a surface thereof an ink-receiving layer comprised of cross-linked gelatin containing calcium acetate.

15. An image-recording element adapted for water-based liquid ink marking in devices such as pen plotters, ink jet printers and the like, said element comprising a biaxially stretched and heat set poly(ethylene terephthalate) film having, in order, on a surface thereof a subbing layer comprised of a terpolymer of acrylonitrile, vinylidene chloride and acrylic acid, and an ink-receiving layer comprised of gelatin cross-linked with bis(vinylsulfonylmethyl)ether and containing calcium acetate.

16. In an inking process in which a water-based liquid ink is applied to the surface of an image-recording element in order to form ink markings thereon, the improvement wherein:

(1) said water-based ink comprises a water-dispersible cross-linkable colorant/resin composition: and (2) said image-recording element comprises a support having thereon an ink-receiving layer of a hydrophilic cross-linkable film-forming material which is cross-linked to a degree sufficient to render it waterfast while permitting it to rapidly absorb said water-based ink, said ink-receiving layer comprising a cross-linking agent that cross-links said colorant/resin composition to thereby render said ink markings waterfast.

17. An inking process as claimed in claim 16, wherein said colorant/resin composition is comprised of a water-dispersible polyester or polyesteramide.

18. An inking process as claimed in claim 16, wherein said colorant/resin composition is comprised of a water-dispersible polyester or polyesteramide having sulfonate functional groups.

19. An inking process as claimed in claiim 16, wherein said colorant/resin composition is comprised of a water-dispersible copolyester of 5-sodiosulfoisophthalic acid.

20. An inking process as claimed in claim 16, wherein said colorant/resin composition is a dye/resin composition.

21. An inking process as claimed in claim 20, wherein the dye in said dye/resin composition is selected from the group consisting of azo, anthraquinone, methine and disazo dyes.

22. An inking process as claimed in claim 20, wherein the dye/resin composition is a water-dispersible composition comprising:

(A) from about 5 to about 60% by weight of disperse dye, and (B) from about 95 to about 40% by weight of linear, water-dispersible copolyester, or (C) from 95 to about 40% by weight of a blend of the copolyester of (B) with up to about 40% by weight based on total weight of said blend of a saturated aliphatic or cycloaliphatic dicarboxylic acid having 6 to 12 carbon atoms, said copolyester being comprised of (D) at least one aliphatic, cycloaliphatic or aromatic dicarboxylic acid component, (E) a diol component of from about 2 to about 28 carbons, at least about 20 mole percent of which is a poly(ethylene glycol) having the formula $H—OCH_2CH_2)_nOH$ wherein n is an integer of from 2 to about 14, and (F) at least one difunctional dicarboxylic acid containing a $—SO_3M$ group attached to an aromatic nucleus, wherein M is hydrogen, $Na^+$, $Li^+$ or $K^+$, and constituting at least about 8 mole percent to about 45 mole percent of the total moles of components (D) and (F).

23. An inking process as claimed in claim 16, wherein said colorant/resin composition is a pigment/resin composition.

24. An inking process as claimed in claim 16, wherein said hydrophilic cross-linkable film-forming material is gelatin.

25. An inking process as claimed in claim 16, wherein said ink-receiving layer comprises gelatin cross-linked by a vinylsulfonyl compound.

26. An inking process as claimed in claim 16, wherein said ink-receiving layer comprises gelatin cross-linked by bis(vinylsulfonylmethyl)ether.

27. An inking process as claimed in claim 16, wherein said support is a polyester film.

28. An inking process as claimed in claim 16, wherein said support is a poly(ethylene terephthalate) film.

29. An inking process as claimed in claim 16, wherein the cross-linking agent that cross-links said colorant/resin composition is a water-soluble salt of a multi-valent metal.

30. An inking process as claimed in claim 16, wherein the cross-linking agent that cross-links said colorant/resin composition is a water-soluble calcium salt.

31. An inking process as claimed in claim 16, wherein the cross-linking agent that cross-links said colorant/resin composition is a water-soluble multi-valent metal acetate.

32. An inking process as claimed in claim 16, wherein the cross-linking agent that cross-links said colorant/resin composition is calcium acetate.

33. An inking process as claimed in claim 16, wherein said ink-receiving layer additionally contains a matting agent.

34. An inking process as claimed in claim 16, wherein said ink-receiving layer additionally contains a vinylbenzyl quaternary ammonium polymer.

35. In an inking process in which a water-based liquid ink is applied to the surface of an image-recording element in order to form ink markings thereon, the improvement wherein:

(1) said water-based ink comprises a water-dispersible composition comprising:

(A) from about 5 to about 60% by weight of disperse dye, and (B) from 95 to about 40% by weight of linear, water-dispersible copolyester, or (C) from 95 to about 40% by weight of a blend of the copolyester of (B) with up to about 40% by weight based on total weight of said blend of a saturated aliphatic or cycloaliphatic dicarboxylic acid having 6 to 12 carbon atoms, said copolyester being comprised of (D) at least one aliphatic, cycloaliphatic or aromatic dicarboxylic acid component, (E) a diol component of from about 2 to about 28 carbons, at least about 20 mole percent of which is a poly(ethylene glycol) having the formula $H—OCH_2CH_2)_nOH$ wherein n is an integer of from 2 to about 14, and (F) at least one difunctional dicarboxylic acid containing a $—SO_3M$ group attached to an aromatic nucleus, wherein M is hydrogen, $Na^+$ $Li^+$ or $K^+$, and constituting at least about 8 mole percent to about 45 mole percent of the total moles of components (D) and (F), and (2) said image-recording element comprises a transparent support having on a surface thereof an ink-receiving layer comprised of cross-linked gelatin containing a water-soluble salt of a multi-valent metal.

36. In an inking process in which a water-based liquid ink is applied to the surface of an image-recording element in order to form ink markings thereon, the improvement wherein:

(1) said water-based ink comprises a water-dispersible composition comprising:

(A) from about 5 to about 60% by weight of disperse dye, and (B) from about 95 to about 40% by weight of linear, water-dispersible copolyester, or (C) from 95 to about 40% by weight of a blend of the copolyester of (B) with up to about 40% by weight based on total weight of said blend of a saturated aliphatic or cycloaliphatic dicarboxylic acid having 6 to 12 carbon atoms, said copolyester being comprised of (D) at least one aliphatic, cycloaliphatic or aromatic dicarboxylic acid component, (E) a diol component of from about 2 to about 28 carbons, at least about 20 mole percent of which is a poly(ethylene glycol) having the formula $H—OCH_2CH_2)_nOH$ wherein n is an integer of from 2 to about 14, and (F) at least one difunctional dicarboxylic acid containing a $—SO_3M$ group attached to an aromatic nucleus, wherein M is hydrogen, $Na^+$, $Li^+$ or $K^+$, and constituting at least about 8 mole percent to about 45 mole percent of the total moles of components (D) and (F), and (2) said image-recorded element comprises a polyester support having on a surface thereof an ink-receiving layer comprised of cross-linked gelatin containing calcium acetate.

37. In an inking process in which a water-based liquid ink is applied to the surface of an image-recording element in order to form ink markings thereon, the improvement wherein:

(1) said water-based ink comprises a water-dispersible composition comprising:

(A) from about 5 to about 60% by weight of disperse dye, and (B) from about 95 to about 40% by weight of linear, water-dispersible copolyester, or (C) from 95 to about 40% by weight of a blend of the copolyester of (B) with up to about 40% by weight based on total weight of said blend of a saturated aliphatic or cycloaliphatic dicarboxylic acid having 6 to 12 carbon atoms, said copolymer being comprised of (D) at least one aliphatic, cycloaliphatic or aromatic dicarboxylic acid component, (E) a diol component of from about 2 to about 28 carbons, at least about 20 mole percent of which is a poly(ethylene glycol) having the formula $H—OCH_2CH_2)_nOH$ wherein n is an integer of from 2 to about 14, and (F) at least one difunctional dicarboxylic acid containing a $—SO_3M$ group attached to an aromatic nucleus, wherein M is hydrogen, $Na^+$, $Li^+$ or $K^+$, and constituting at least about 8 mole percent to about 45 mole percent of the total moles of components (D) and (F), and (2) said image-recording element comprises a biaxially stretched and heat set poly(ethylene terephthalate) film having, in order, on a surface thereof a subbing layer comprised of a terpolymer of acrylonitrile, vinylidene chloride and acrylic acid, and an ink-receiving layer comprised of gelatin cross-linked with bis(vinylsulfonylmethyl)ether and containing calcium acetate.

* * * * *